US005634769A

United States Patent [19]

Metzinger

[11] Patent Number: 5,634,769

[45] Date of Patent: Jun. 3, 1997

[54] GUIDE APPARATUS FOR CENTRIFUGAL PUMPS

[75] Inventor: Wolfgang Metzinger, Pegnitz, Germany

[73] Assignee: KSB Aktiengesellschaft, Frankenthal, Germany

[21] Appl. No.: 568,959

[22] Filed: Dec. 7, 1995

Related U.S. Application Data

[63] Continuation of Ser. No. 323,919, Oct. 17, 1994, abandoned.

[30] Foreign Application Priority Data

Oct. 28, 1993 [DE] Germany ..... 43 36 852.2

[51] Int. Cl.[6] ..... F04D 29/44

[52] U.S. Cl. ..... 415/208.3; 415/211.1

[58] Field of Search ..... 415/208.3, 211.1, 415/211.2, 901; 417/424.1

[56] References Cited

U.S. PATENT DOCUMENTS

| | | | |
|---|---|---|---|
| 3,154,019 | 10/1964 | Hoyt | 415/208.3 |
| 3,945,771 | 3/1976 | Arakawa | 415/208.3 |

FOREIGN PATENT DOCUMENTS

| | | | |
|---|---|---|---|
| 0475920A1 | 3/1992 | European Pat. Off. . | |
| 0566087A1 | 10/1993 | European Pat. Off. . | |
| 140602 | 12/1978 | Japan | 415/208.3 |
| 419544 | 12/1934 | United Kingdom . | |

*Primary Examiner*—James Larson
*Attorney, Agent, or Firm*—Darby & Darby

[57] ABSTRACT

A guide apparatus for use with centrifugal pumps which transport fluids that contain foreign bodies. The guide apparatus includes a plurality of guide blades. Each of the guide blades has a predetermined width. Each guide blade has a rounded guide-blade protrusion which has a rounding radius. A ratio of the rounding radius to the width of the guide blade ranges from 0.15 to 0.5. Each of the guide blades, in an inlet area of the guide apparatus, has an approach angle. The approach angle corresponds to an angle between a direction of a tangent to a curve of the path of a fluid particle in the transported liquid and a tangent to a circle about a rotational axis of the pump. Each of the guide blades outlet edge is disposed steeper than the guide blade inlet edge by such an amount that the flow of fluid substantially always approaches the guide blade in a manner so as to represent a partial load.

3 Claims, 2 Drawing Sheets

GUIDE APPARATUS FOR CENTRIFUGAL PUMPS

This is a continuation of application Ser. No. 08/343,919, filed Oct. 17, 1994, abandoned.

FIELD OF THE INVENTION

The present invention relates to a guide apparatus for use with centrifugal pumps. More specifically, the present invention is directed to a guide apparatus that includes several guide blades which permit the transport of liquids that contain foreign bodies.

BACKGROUND OF THE INVENTION

The transport of contaminated liquids by centrifugal pumps presents difficulties not only to the blade wheels of such pumps, but in principle to all parts of the pump within the flow path of the liquid. Such difficulties include, inter alia, the risk of plugging or blocking flow through a portion or even through the entire pump. Current-carrying interior parts, constrictions, and edges are areas of special concern. Accordingly, when designing a centrifugal pump, one always strives to avoid or minimize these problems. However, as a result, the pump housing is relatively large due to the generous flow guidance, which largely eliminates the troublesome effects. This is especially true for submersible motor-driven pumps which have a radial or semi-axial outlet, and are used in pipe shafts where the transport medium must be eventually deflected into the axial direction. These centrifugal pumps are constructed with a very large radius and consequently require a large installation diameter, which in turn creates high construction costs for the pipes receiving these pumps.

SUMMARY OF THE INVENTION

It is an object of the present invention to create a guide apparatus that has several guide blades, which not only meets the requirement of maintaining blockage free transport of liquids contaminated with foreign bodies but also the requirement for a small radial dimension.

According to the present invention, this object is achieved by each guide blade having the following combination of characteristics:

a) the guide-blade protrusion is strongly rounded, such that the ratio of the rounding radius to the axial width of the guide-blade in the entry region of the guide apparatus is 0.15 to 0.5;

b) the approach angle of the guide blade in the entry region of the guide apparatus corresponds to the direction of the tangent to the curve of the path of a fluid particle in the transported liquid;

c) the pressure side of the guide blade is set steeper than the suction side by such an amount that the flow always approaches the guide-blade such that the flow represents a partial load.

For characteristics b and c, a range is preferred such that the approach angle $\alpha_s \leqq 20$ degrees, and the angle $\alpha_d$ measured on the pressure side of the guide-blade is $\geqq 50$ degrees.

For a submersible, motor-driven pump in a pipe-shaft design, the present invention suitably proposes that the pump housing contains a guide apparatus formed as a support body, in which the transport medium flowing from the blade wheel of the centrifugal pump is deflected in the axial direction.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENT INVENTION

Figure 1:
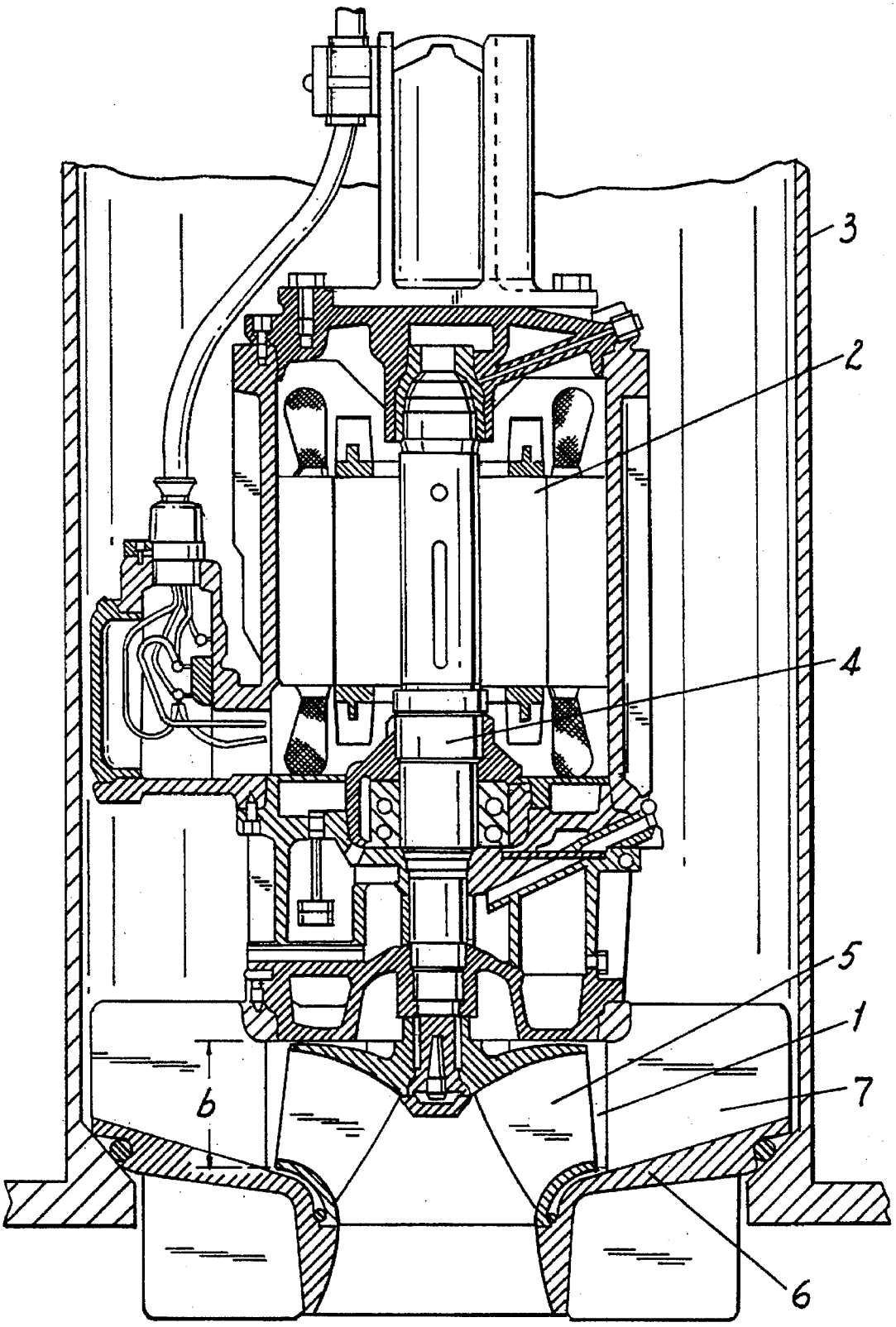
FIG. 1 is a sectional view of a pump, disposed in a pipe and being driven by an electric motor.

Referring now to FIG. 1, an assembly includes a centrifugal pump 1 and an electric motor 2. Pump 1 and motor 2 are disposed at the lower end of a pipe or shaft 3 within a container (not shown). The centrifugal pump 1 includes a blade wheel or impeller 5 which is fixedly connected to shaft 4. Shaft 4 extends into and is rotated by a rotor of electric motor 2. Blade wheel 5 is enclosed by a pump housing 6. Part of the pump housing 6 is a support body for the motor and pump and is also formed as a guide apparatus 7. The fluid which radially flows from the blade wheel 5 is deflected in the axial direction by guide apparatus 7, so that the fluid can be transported upward through pipe shaft 3.

Figure 2:
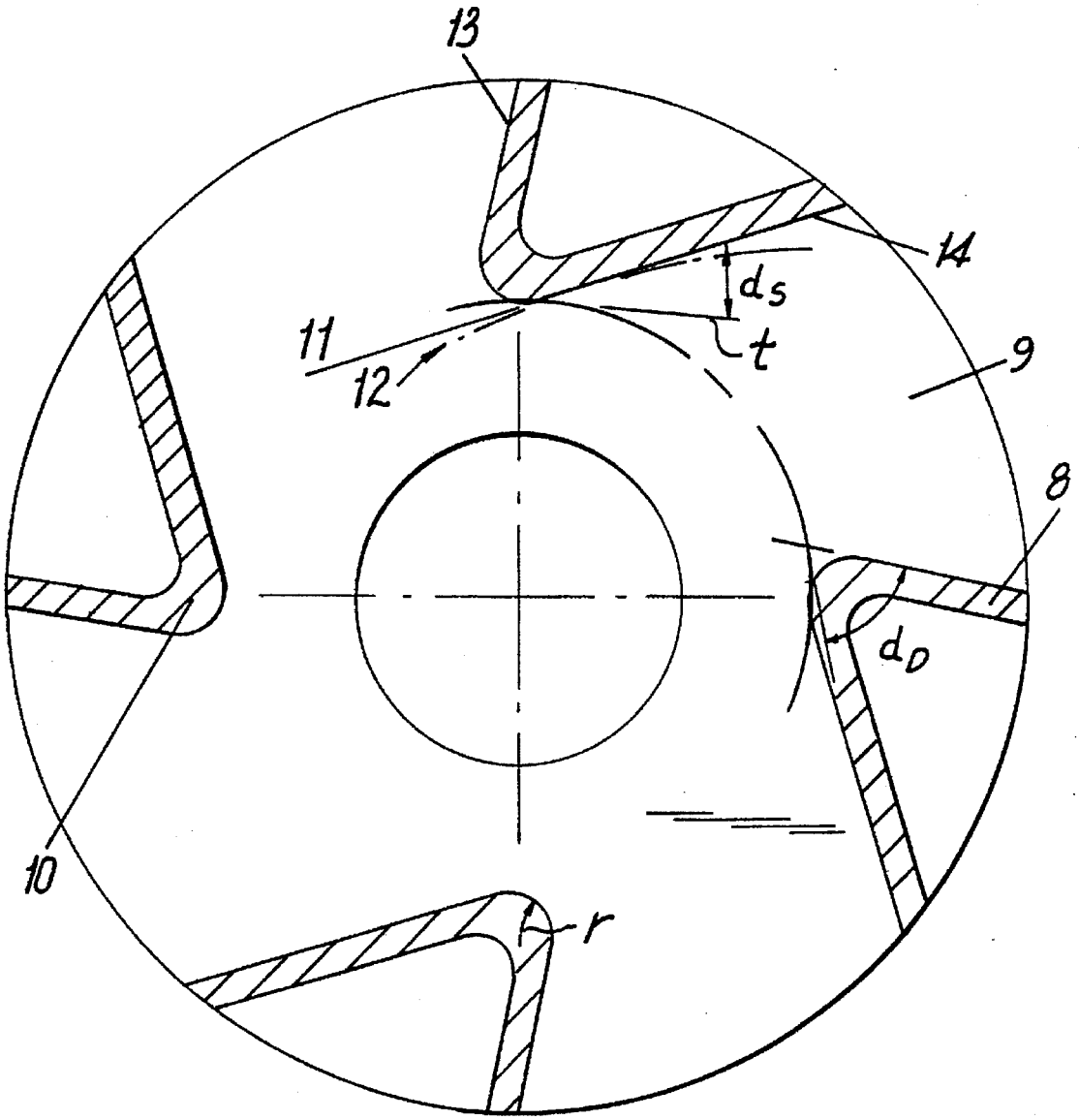
FIG. 2 is a sectional view of a guide wheel of the pump shown in FIG. 1.

Guide apparatus 7 is shown in section in FIG. 2. Guide apparatus 7 has four guide blades 8, which are distributed uniformly over the circumference of the guide apparatus 7. A guide channel 9 for the fluid medium is formed between each of two adjacent guide blades 8. Each of the guide blades 8 has a strongly rounded guide-blade projection 10. The ratio of the rounding radius r of the guide-blade projection 10 to the axial width b (See FIG. 1) of the guide channel 9 is preferably about 0.3. The approach angle $\alpha_s$ of the guide blade 8, measured in the entry region of the guide wheel 7, corresponds to the direction of a tangent 11 to the curve 12 of the path of a fluid particle in the transported liquid medium. The pressure side 13 of the guide blade, 8 is set steeper than the suction side 14. In other words, $\alpha_d$ is greater than $\alpha_s$ and preferably by such an amount that the flow always approaches guide blade 8 in a manner so as to represent a partial load.

The characteristics mentioned above have the effect that mixtures or foreign bodies contained in the transported liquid, even long fibrous members, are carried past the guide-blade protrusions 10, where, due to the prevailing flow conditions, these members will find no place to hold on to for possible adhesion to protrusion 10. Thus, the transport medium flowing radially from the blade wheel 5 is deflected in the axial direction along the shortest possible path while simultaneously preventing accumulation of foreign bodies in the guide apparatus thus preventing a blockage of flow through the pump.

Having described the presently preferred exemplary embodiment of a new and improved guide apparatus for centrifugal pumps, in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

I claim:

1. A guide apparatus for use with centrifugal pumps which transport fluids that contain foreign bodies, said guide apparatus comprising:

a plurality of guide blades, each of said guide blades having a suction side, a pressure side and a predetermined width; wherein each guide blade comprises:

a rounded guide-blade protrusion, said protrusion having a rounding radius, a ratio of the rounding radius to the width of the guide blade ranging from 0.15 to 0.5;

each of said guide blades in an inlet area of the guide apparatus has an approach angle, said approach angle corresponds to an angle between a direction of a tangent to a curve of the path of a fluid particle in a transported fluid and a tangent to a circle about a rotational axis of said pump;

each of said guide blades pressure side is disposed steeper than the guide blade suction side by such an amount that the flow of fluid substantially always approaches the guide blade in a manner so as to represent a partial load.

2. The guide apparatus of claim 1, wherein said approach angle is less than or equal to 20 degrees, and an angle measured between the pressure side of the guide blade and a tangent to said circle is greater than or equal to 50 degrees.

3. The guide apparatus of claim 1, further including a pump housing connected to said guide apparatus, said guide apparatus forming a support for said pump housing, said guide apparatus deflecting the transport fluid, which flows radially from a blade wheel of said centrifugal pump, in the axial direction.

* * * * *